US006089422A

United States Patent [19]

Gibson

[11] Patent Number: 6,089,422

[45] Date of Patent: Jul. 18, 2000

[54] COLLAR STIFFENING DEVICE AND METHOD

[76] Inventor: Lee G. Gibson, 611 Twain St., Spring, Tex. 77373

[21] Appl. No.: 09/234,916

[22] Filed: Jan. 21, 1999

[51] Int. Cl.[7] ..... A41M 43/00; A41B 3/00

[52] U.S. Cl. ..... 223/84; 223/1; 2/129

[58] Field of Search ..... 2/137, 260.1, 129–132, 2/175.4, 195.5, 175.5, 195.6; 223/52, 52.1, 82, 83, 84, 1

[56] References Cited

U.S. PATENT DOCUMENTS

| | | | |
|---|---|---|---|
| 1,845,884 | 2/1932 | Marinsky . | |
| 2,474,058 | 6/1949 | McNeil . | |
| 2,510,030 | 5/1950 | Carlisle . | |
| 2,744,255 | 5/1956 | Portias . | |
| 3,865,286 | 2/1975 | Tiss | 223/83 |
| 3,909,850 | 10/1975 | Scott . | |
| 4,093,498 | 6/1978 | Wendell . | |
| 4,169,753 | 10/1979 | Wendell . | |
| 4,223,815 | 9/1980 | Mitchell et al. . | |
| 4,228,547 | 10/1980 | Peterson . | |
| 4,798,293 | 1/1989 | Carstens | 206/495 |
| 4,922,553 | 5/1990 | Morrone . | |
| 5,269,691 | 12/1993 | Waldman | 434/429 |
| 5,626,267 | 5/1997 | Peruski . | |
| 5,769,288 | 6/1998 | Berglund | 223/84 |

FOREIGN PATENT DOCUMENTS

| | | |
|---|---|---|
| 620402 | 3/1994 | Japan . |

OTHER PUBLICATIONS

"AIA Products"—Tape and Shape/Printed Collar Stay.

*Primary Examiner*—Bibhu Mohanty
*Attorney, Agent, or Firm*—Wendy K. Buskop; Buskop Law Group

[57] ABSTRACT

The invention is a collar stiffening means comprising a base with two surfaces wherein the base has depicted upon one of its two surfaces one or more geometric shapes and upon the other of its two surfaces, an adhesive with a removably affixed cover so that the adhesive side of the base can be pressed upon the underside of a collar for stiffening the collar, thereby improving the appearance of the collar.

27 Claims, 2 Drawing Sheets

COLLAR STIFFENING DEVICE AND METHOD

BACKGROUND OF THE INVENTION

The present invention relates to a collar stiffening device and method. An object of the invention is to provide a device of sufficient stiffness and flexibility of design, which will be described hereafter, by which the front parts of a soft collar may be preserved against curling at the points or presenting a rumpled appearance, and at the same time permitting a natural form fitting or molded appearance, which enables a soft collar to look like a pressed collar.

SUMMARY OF THE INVENTION

It is well known in the prior art that single layer knit collar lapels tend to curl as a result of washing, drying and as a result of exposure to hot humid weather. Many consumers find they can launder their knit shirts without ironing and have an acceptably neat look except for the curling collar lapels. Even the most discriminating dresser discovers their perfectly ironed collars curling in the hot humid summer when spending any length of time out doors. In the past, others have addressed the problem by adding reinforcement between the layers in the collar or by attaching some support underneath the collar offering one particular shape without the flexibility of changing the shape to create ultimately the most functional shape for their particular collar, personal preference of how that collar should look, and the optimum result.

The present invention solves the problem with its trim to fit feature and its three-dimensional support. Others have not included the additional feature of allowing for the use of advertising on the graphics surfaces. Others have not included the feature of patterns for the adhesive to leave the supportive base material visually undetectable.

The present invention has a temporary adhesive coating on one side except for an area approximately ⅛" in width along the edge which is to be positioned farthest from the shirt opening, which disposition has the benefit of allowing the collar fabric to move in relation to the rear portion of the base, thus eliminating any visible line where the rear edge of the stiffening means meets the collar, and rendering the invention invisible in normal usage. Additionally the adhesive may depict a pattern which offers advertising value, instructions for use, suggested patterns for trimming, or other information.

The other side of the base, the side opposite the adhesive, displays graphics to show suggested trim designs, suggested positioning on the collar lapel, the product trademark, and potential advertising. The shape of the base in the preferred embodiment resembles a rounded-corner trapezoid which universally matches the most common collar lapels. After removing the cover, the base is affixed to the underside of the collar lapel. The material is sufficiently firm to provide the requisite support and lightweight enough to not be noticeable to the wearer.

DESCRIPTION OF THE INVENTION

Figure 1:
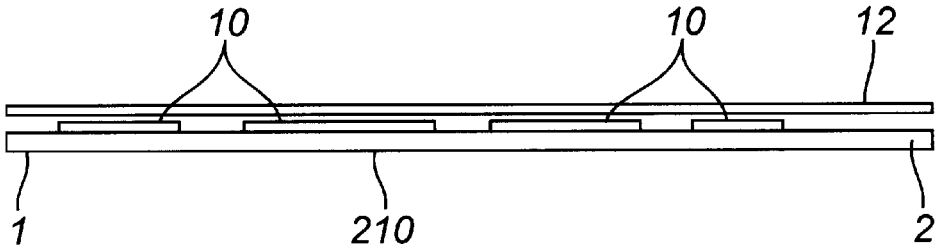
FIG. 1 is a cross section showing the structure of the invention.
Figure 2:
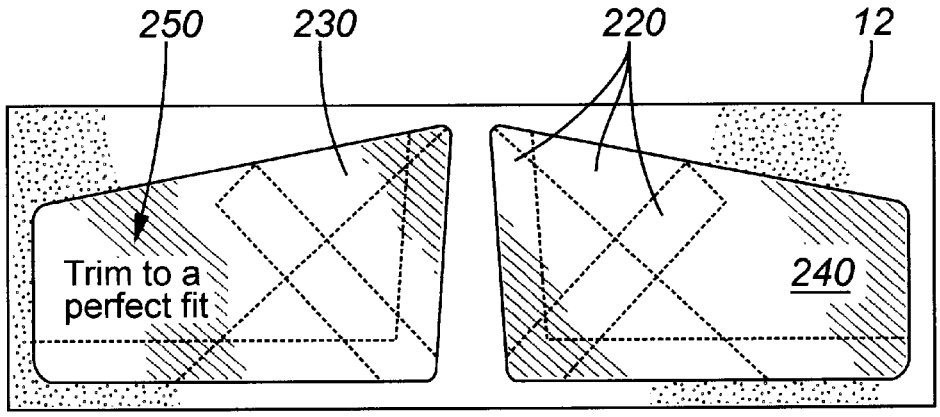
FIG. 2 is top plan view of the preferred embodiment of the invention.

As shown in FIGS. 1 and 2, the present invention relates to a base (1) of substantially rectangular configuration which is formed of a semi-rigid material, such as paper (2) or a polymeric material. The base material has depicted on it, such as through printing or through a pattern of adhesive, various geometrical shapes (4), (6) and (8). The semi-rigid base material (2) has disposed on it an adhesive material (10) over at least a portion, and optionally, over an entire side of the base material (2). Removably affixed to the adhesive (10) of the base material (2) is a flexible cover, which can be a sheet (12) or a series of small covers, which can be removed or peeled off to expose the adhesive portions of the invention. The flexible cover may optionally have advertising, instructions for use, or other information depicted on it.

There may be a multiplicity of geometrical shapes on the base (4, 6, 8), and the geometrical shapes may be disposed on the base so as to overlap one another (220). The base itself (1) may be shaped as a triangle, a trapezoid, or any other geometrical shape suitable for use as a means of stiffening collars. It is contemplated that within the scope of the present invention the base of the collar stiffening means can be trapezoidal in shape, so that the collar stiffening means could be used without cutting or trimming to a different shape, to stiffen a shirt collar. Bases can be manufactured in complementary shapes (230, 240) so as to be suitable for affixing to the left side (230) or the right side (240) of a collar (50). The base (1) can be manufactured in a variety of sizes for use on different sizes of collars.

The base (1) may be tinted with pigment to be any color. The base (1) may be colorless, clear, transparent, or translucent.

The base (1) is of a size that provides upon its surfaces sufficient room to dispose printed information (250). The printed information may comprise trademarks, advertising, manufacturer's logos, instructions for use, or any other information suitable for printing on a means for stiffening collars. The geometric shapes can be depicted on the base (1) using a printing technique, such as ink, stamped imprints, embossing, or any known technique for creating a visible impression on the surface of said base (1).

The base (1) material used in the invention can be made from paper, plastic, polymers, laminated structures, or even thin metallic structures, such as a very thin aluminum, or any other material suitable for use in a means for stiffening collars. The base (1) material can comprise a biodegradable substance. It is contemplated that it is within the scope of the present invention that the collar stiffening means could be disposable.

The adhesive (10) can be a glue, epoxy resin, cement or any adhesive appropriate for use in attaching a means for stiffening collars. The flexible cover can be comprised of wax paper, thin plastic, polymer film, coated paper, removable thin film, or any material suitable for removably covering adhesive.

The typical shirt (52) has a body (54), at least arm holes (60), and a collar (50) having an upper surface (64), an underside surface (58), and a front edge (62), for use with this device. The present invention can be applied to a range of collars on a range of garments. The invention can be used with garments for men, women, or children including, for example, short-sleeved shirts and blouses, heavier winter shirts, jackets, and coats.

Figure 3:
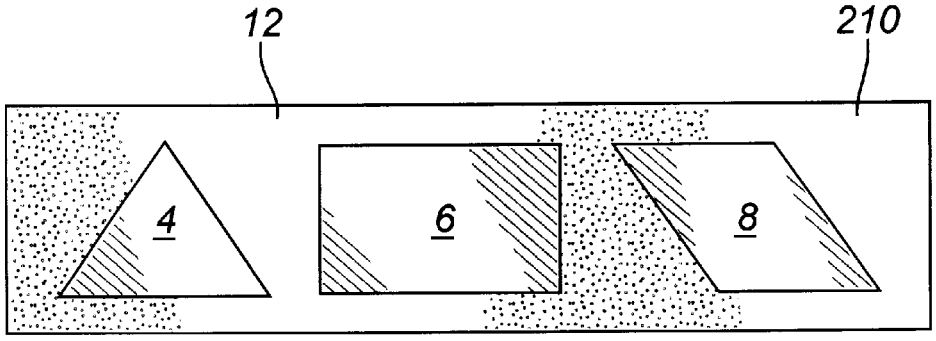
FIG. 3 is a top plan view of an alternative embodiment of the invention.

A user can select the appropriate geometric shape (4), (6) or (8) desired to be used on the underside of a shirt collar (50) as shown in FIG. 3 and cut or trim the base (1) with adhesive (10) and cover (12) along the lines of the desired shape (4),(6) or (8). The user can then remove the cover (12), exposing the adhesive (10), align the cut shape on the collar (50) of a shirt (52) or other garment, and then press the material (2) onto the underside of the collar (50) of the shirt (52) to provide the desired stiffened shape. A user can alternatively trim or cut the base with adhesive and cover to create a shape different from the shapes depicted on the base.

As can be seen from the detailed description, a collar stiffening means manufactured and used in accordance with the present invention will provide these advantages. The invention is especially useful for the kind of single layer knit fabric collars which are difficult to hold in shape. The invention can be applied with a temporary adhesive leaving no residue on the shirt collar after removal. The invention is visually undetectable after applying. The invention can be disposable. The invention can be reusable. The invention affixes to the underside of the collar lapels. The invention can be manufactured separately from the collars to which it is affixed, and can be affixed to collars later as an after-market product. The invention can be affixed at any time to finished goods. The invention can be used before and in particular during wear and removed before laundering. The invention will prevent collars from curling, wrinkling and becoming disfigured both during wear and prior to wear during storage. The invention replaces the need to iron collars. The invention can be applied conveniently in seconds. If the base element of the invention is used without trimming, then the invention applies conveniently in seconds with no need for additional tools or equipment. The invention does not require special holes in the lapel to hold it in place, thus offering broad application and universal appeal. The invention offers opportunities for advertisers to present a message or their logo to users by adding graphics. The invention can be trimmed to fit any shape collar. Graphics imprinted on the base of the invention or created by the pattern of the adhesive can offer several suggested patterns for various collar lapels to provide for the most functional and attractive result based on the shape of particular collar lapels and personal preference. The invention prevents curling in all six directions of a three dimensional design: North, South, West, East, In and Out.

Figure 4:
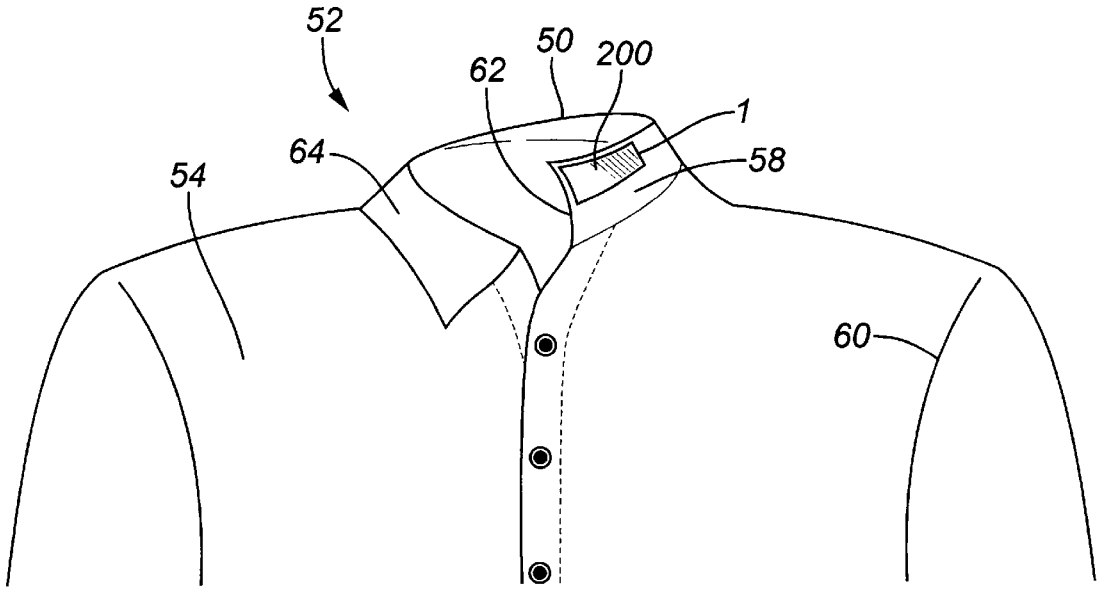
FIG. 4 is a view of the invention affixed to a collar using a specific geometric shape.

The preferred embodiment is shown in FIG. 2. The embodiment as shown in FIG. 2 comprises two bases (230, 240), one each for the left (230) and right (240) side of a collar to be stiffened. The bases (230, 240) are affixed with adhesive to a single cover (12) larger in surface area than the bases (230, 240) that are affixed to it. The bases (230, 240) have imprinted upon them a multiplicity of geometric shapes available for trimming by a user. FIG. 4 shows a collar stiffening means (200) with its adhesive cover removed and its base (1) pressed to and adhering to the underside of a shirt collar (50). Alternatively the adhesive can be reusable.

In the preferred embodiment, the adhesive (10) is water soluble, so as to come off in laundry water. Alternatively the adhesive (10) can be non-water soluble, so as to form a more permanent bond of the base (1) to the collar (50), allowing the collar (50) to be laundered with the base (1) still attached to the collar (50). Alternatively the adhesive (10) can be non-soluble in petroleum-based solvents such as naphtha or ether, so as to form a more permanent bond of the base (1) to the collar (50), allowing the collar to be dry-cleaned with the base (1) still attached to the collar (50). In the preferred embodiment, the adhesive (10) is disposed on the base (1) in a uniform layer covering the base (1) except for an area approximately ⅛" wide along the edge which is to be positioned farthest from the shirt opening. Alternatively, the adhesive (10) can be disposed on the base (1) in small spots distributed randomly over the surface of the base (1). The adhesive (10) alternatively can be disposed on the base (1) in medium-sized spots distributed at regular intervals over the surface of the base (1). The adhesive can be disposed on the base so as to depict graphics. The adhesive (10) can be disposed on the base (1) in any configuration suitable for use on the base (1) of a means for stiffening collars.

In the preferred embodiment, the base (1) is attached to the collar (50) removably with adhesive. Alternatively the base (1) may be attached to the collar (50) by other suitable means for attaching stiffeners to collars. For example, the base (1) may be sewn to the collar (50), or the base (1) could be heat-fused to the collar (50).

In FIGS. 3 and 4, the bases are shown as light in color. Alternatively bases (1) may be of any color suitable for use in a means of stiffening collars. The bases (1) can be manufactured in a variety of colors to match a variety of collar colors. The bases (1) can be clear, colorless, transparent, or translucent.

Figure 5:
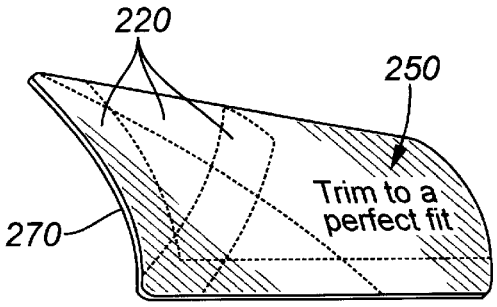
FIG. 5 is a front view of an alternative embodiment showing a convex base.

In the preferred embodiment, the base (1) is flat. Alternatively the base can be manufactured so that it is convex when viewed from the collar side (270), as shown in FIG. 5. Manufacturing the base so that is convex enables the user to achieve a gracefully curved appearance of the collar in addition to all the other attendant advantages of the present invention.

What is claimed is:

1. A collar stiffening means comprising:

a base having a first surface and second surface, wherein said base has various geometric shapes selected from the group consisting of: a triangle, a first large trapezoid, a second small trapezoid, a right angle L shape and a rectangle having a triangular end depicted on said first surface; an adhesive disposed on at least a portion of said second surface of said base; and a cover removably affixed to said adhesive.

2. The collar stiffening means of claim 1, wherein said various geometric shapes are depicted on said first surface wherein said shapes are overlapping each other.

3. The collar stiffening means of claim 1, wherein said base is in the shape of a trapezoid.

4. The collar stiffening means of claim 1, wherein at least 5 geometric shapes are depicted on said first surface.

5. The collar stiffening means of claim 4, wherein the base is trimmed into a shape depicted on said first surface.

6. The collar stiffening means of claim 1, wherein the base is trimmed into a shape different from that depicted on said first surface.

7. The collar stiffening means of claim 1, wherein said first surface further has instructions for use depicted on it.

8. The collar stiffening means of claim 1, wherein additional printing in the form of advertising is depicted upon said first surface.

9. The collar stiffening means of claim 1, wherein said base is tinted with pigment.

10. The collar stiffening means of claim 1, wherein said base is transparent.

11. The collar stiffening means of claim 1, wherein the base material can be selected from the group comprising: paper, a flexible polymer, a laminated structure, and mixtures thereof.

12. The collar stiffening means of claim 1, wherein the adhesive is a glue.

13. The collar stiffening means of claim 1, wherein the cover comprises a member of the group: wax paper, thin plastic, polymer film, coated paper, or removable thin film.

14. The collar stiffening means of claim 1, wherein the base is a biodegradable substance.

15. The collar stiffening means of claim 1, wherein the adhesive is a non-water soluble substance.

16. A collar stiffening means comprising:

a base having a first surface and a second surface, wherein said base has various geometric shapes depicted on said first surface; an adhesive disposed on at least a portion of said second surface of said base; and a cover removably affixed to said adhesive, and wherein the adhesive is tinted with pigment and applied to the base so as to depict readable information.

17. The collar stiffening means of claim 17, wherein said adhesive tinted with pigment is applied to a transparent base.

18. The collar stiffening means of claim 1, wherein the base is flat.

19. The collar stiffening means of claim 1, wherein the base is convex.

20. The combination of a shirt provided with a collar stiffening means, wherein said shirt comprises:

a body with armholes;

a collar having an upper surface and an underside surface; and wherein said collar stiffening means further comprises:

a base having a first surface and second surface, wherein said base has various geometric shapes selected from the group consisting of: a triangle, a first large trapezoid, a second small trapezoid, a right angle L shape, and a rectangle having a triangular end depicted on said first surface;

an adhesive disposed on at least a portion of said second surface of said base; and a cover removably affixed to said adhesive.

21. The combination of a shirt provided with a collar stiffening means as in claim 20, wherein said collar stiffening means is removably affixed to the underside surface of the collar, thereby providing stiffening to the collar.

22. The combination of a shirt provided with a collar stiffening means as in claim 20, wherein the adhesive is a glue.

23. The combination of a shirt provided with a collar stiffening means as in claim 20, wherein the base is a biodegradable substance.

24. The combination of a shirt provided with a collar stiffening means as in claim 20, wherein the adhesive is a non-water soluble substance.

25. A method for stiffening the collar of a shirt wherein the collar has a front edge, using a collar stiffening means having a base having a first surface and a second surface, wherein said base has various geometric shapes depicted on said first surface; an adhesive disposed on at least a portion of said second surface of said base; and a cover removably affixed to said adhesive, comprising the steps of:

selecting a desired geometric shape to be used from one or more of the various geometric shapes depicted on the collar stiffening means;

trimming said collar stiffening means to that of a geometric shape depicted on said first surface of said collar stiffening means after selecting the desired geometric shape from the geometric shapes depicted on the collar stiffening means;

removing the cover from the adhesive on the second surface of the collar stiffening means;

aligning the collar stiffening means with the front edge of said collar; and removably affixing the aligned collar stiffening means to the underside surface of the collar of the shirt and thereby providing stiffening to the collar of said shirt.

26. The method of claim 25, in which the first step of selecting the desired geometric shape from the geometric shapes depicted on the collar stiffening means is replaced with the step comprising selecting the desired geometric shape from geometric shapes different from those depicted on the collar stiffening means.

27. The method of claim 26, further comprising the additional step of trimming said collar stiffening means to that of a geometric shape different from those depicted on the first surface of said collar stiffening means after selecting the desired geometric shape from geometric shapes different from those depicted on the collar stiffening means.

* * * * *